United States Patent [19]

Skinner

[11] 4,173,434

[45] Nov. 6, 1979

[54] PRESSURE REGULATOR FOR A FLUID PUMP

[75] Inventor: Robert T. J. Skinner, High Wycombe, England

[73] Assignee: Lucas Industries Limited, Birmingham, England

[21] Appl. No.: 858,943

[22] Filed: Dec. 9, 1977

[30] Foreign Application Priority Data

Dec. 17, 1976 [GB] United Kingdom ..... 52940/76

[51] Int. Cl.[2] ..... F04B 49/00

[52] U.S. Cl. ..... 417/294; 123/139 AF; 417/307; 417/310

[58] Field of Search ..... 417/294, 307, 310; 123/139 AF, 139 AN

[56] References Cited

U.S. PATENT DOCUMENTS

| | | | |
|---|---|---|---|
| 2,910,976 | 11/1959 | Fancher | 417/294 X |
| 3,036,565 | 5/1962 | Reiners | 123/139 AF |
| 3,074,472 | 1/1963 | Williams | 123/139 AF |
| 3,077,921 | 2/1963 | Zubaty et al. | 417/294 X |
| 3,465,679 | 9/1969 | Adey et al. | 417/294 X |
| 3,536,421 | 10/1970 | Kemp | 417/294 X |
| 4,038,956 | 8/1977 | Pan et al. | 123/139 AF |
| 4,041,920 | 8/1977 | Skinner | 417/294 X |

FOREIGN PATENT DOCUMENTS

| | | | |
|---|---|---|---|
| 933291 | 8/1963 | United Kingdom | 123/179 L |

*Primary Examiner*—Carlton R. Croyle
*Assistant Examiner*—Edward Look

[57] ABSTRACT

A pressure regulator for controlling the output pressure of a fluid pump comprises a first member having at least one orifice opening out onto a surface of the member, a further member which is biased into contact with the surface so as to obturate said orifice, resilient means biasing the member into contact with said surface and speed responsive means acting to assist said spring. The output pressure of the pump being controlled in accordance with the force exerted by the spring and the speed responsive means.

3 Claims, 2 Drawing Figures

PRESSURE REGULATOR FOR A FLUID PUMP

This invention relates to a pressure regulator for controlling the output pressure of a fluid pump in accordance with the speed at which the pump is driven, more particularly a fluid pump of the type used for supplying liquid fuel under pressure to an injection pump for an internal combustion engine.

The object of the invention is to provide a pressure regulator for the purpose specified in a simple and convenient form.

According to the invention a pressure regulator for the purpose specified comprises a first member having at least one orifice formed therein, said orifice breaking out onto one surface of the member, said orifice in use being connected to the outlet of the pump, a second member in contact with said face and arranged to control the flow of fluid through said orifice, resilient means urging said members into contact with each other and means responsive to the speed of the pump for applying a force to assist the action of said resilient means, the arrangement being such that the outlet pressure of the pump acts in opposition to the forces exerted by the resilient means and the speed responsive means, to separate said members thereby to allow fluid to escape from the outlet of the pump to control the output pressure thereof.

According to a further feature of the invention the means responsive to the speed at which the pump is driven comprises an axially movable rotor, an annular surface defined on said rotor, said annular surface being inclined relative to a plane normal to the axis of rotation, and a plurality of weight members disposed between said annular surface and a reaction surface, the centrifugal force acting on said members being converted to an axial force on the rotor to urge said members into engagement with each other.

According to a further feature of the invention said first member surrounds a shaft coupled to said rotor, and a plurality of orifices is provided in said first member, said orifices being substantially equi-angularly spaced about and equi-distant from the axis of said shaft, said rotor mounting an annular projection defining said second member.

Figure 1:
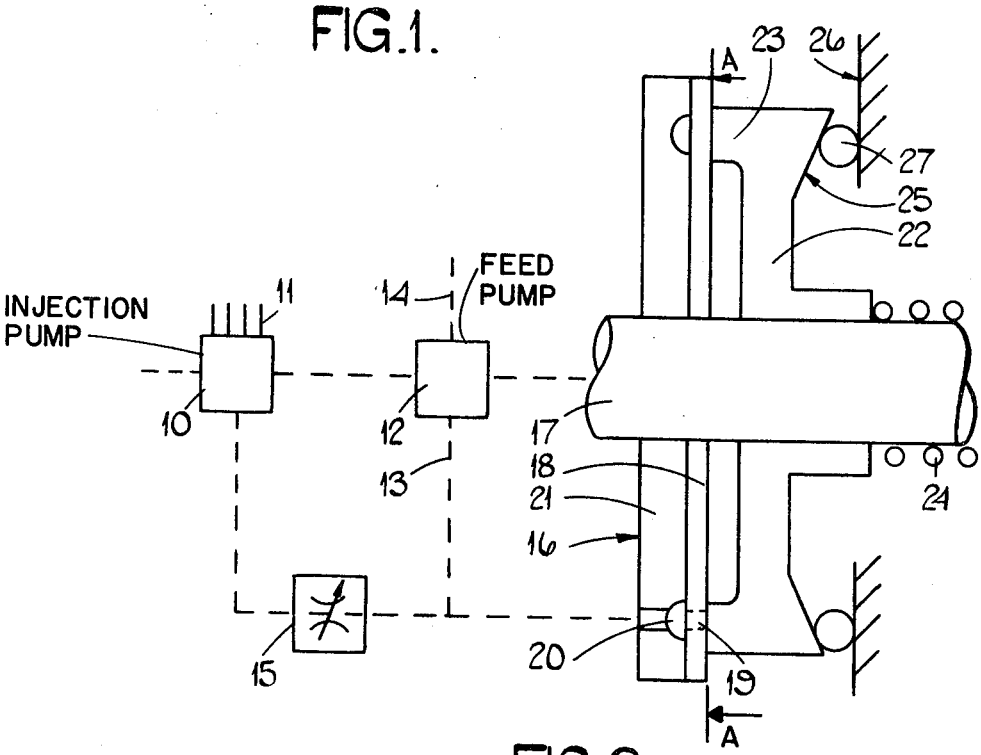
Figure 2:
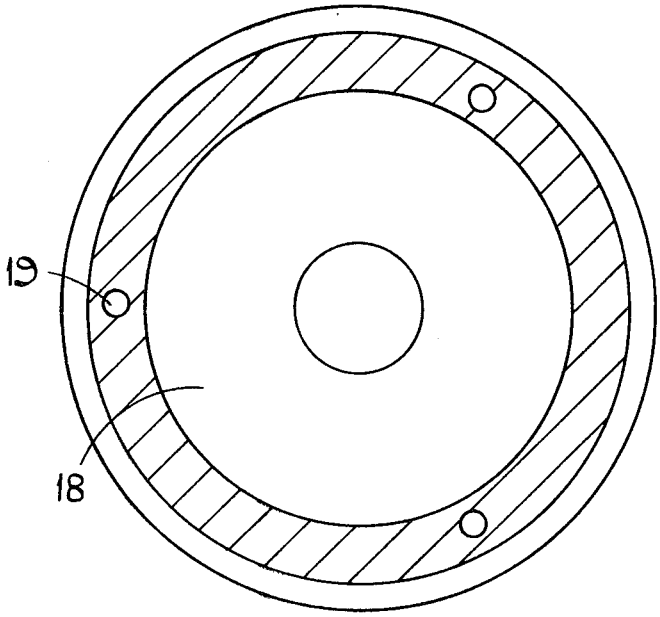

One example of a pressure regulator in accordance with the invention will now be described with reference to the accompanying drawings in which:

FIG. 1 shows the regulator associated with the components of a fuel pumping apparatus for supplying fuel to an internal combustion engine and, FIG. 2 is a view in the direction of the arrow A of part of the regulator seen in FIG. 1.

With reference to the drawings, the apparatus includes an injection pump 10 having a plurality of outlets 11 which in use, are connected to the injection nozzles of an internal combustion engine. The injection pump is driven in timed relationship with the associated engine.

For supplying fuel to the injection pump 10 there is provided a feed pump 12 which is of the constant displacement type and which conveniently includes a number of vanes rotatable within an eccentrically disposed pump chamber. The feed pump 12 has an outlet 13 and an inlet 14 the latter in use, being connected to a source of liquid fuel. The outlet 13 is connected to an inlet of the injection pump by way of a throttle 15. The throttle includes an adjustable orifice through which the fuel flows and the size of this orifice determines the amount of fuel which is supplied to the injection pump during a filling stroke thereof, and therefore the amount of fuel which is supplied by the injection pump during an injection stroke. The throttle means is usually associated with some form of governor mechanism either a mechanical governor having centrifugal weights the force exerted by which is opposed by a governor spring with the setting of the weights adjusting the effective size of the orifice. An operator adjustable member is provided either to adjust the force exerted by the spring or alter a fulcrum point in the linkage connecting the weights and the orifice. Alternatively, the governor means may be hydraulically operated in which case a piston is subjected to the outlet pressure of the feed pump, and the force developed by this pressure is opposed by a spring. The piston conveniently defines with the wall of the cylinder, the aforementioned adjustable orifice. An operator adjustable member is provided to control the force exerted by the governor spring.

With either of the mechanisms described but particularly with the hydraulic governor mechanism, the operation of the apparatus is improved by close control of the output pressure of the feed pump. In apparatus of this type it is arranged that the feed pump always supplies fuel in excess of that which is supplied by the engine.

In order to control the output pressure of the feed pump a pressure regulator generally indicated at 16 is provided.

The regulator includes a shaft 17 which conveniently forms an extension of the rotary part of the injection pump and the feed pump but if it is not formed as an extension of the aforesaid rotary parts, it is coupled thereto. Also provided is a first member 18 in the form of an annular disc which surrounds the shaft 17. The disc 18 lies in a plane normal to the axis of rotation of the shaft and formed in the disc are three circumferentially spaced orifices 19 which are spaced an equal distance from the axis of rotation of the shaft. The orifices communicate with an annular groove 20 formed in the face of a backing plate 21 and the groove 20 is in communication with the outlet 13 of the feed pump.

Also provided is a rotor 22 which is mounted upon the shaft so as to be angularly movable therewith. The rotor is however axially movable upon the shaft and it defines an annular projection 23 which engages the disc 18. The rotor is biased by a coiled compression spring 24 in the direction such that the projection engages with the face of the disc 18. As shown by the shaded area in FIG. 2, the projection 23 obturates the orifices 19. The rotor also defines an annular surface 25 which is inclined to a plane normal to the axis of rotation of the rotor and disposed between this surface and a reaction surface 26 are a plurality of ball bearings 27 these being located within a cage (not shown).

In operation, the fuel pressure within the orifices 19 generates an axial force on the projection which urges the rotor against the action of the spring 24 and an axial force which is generated by the ball bearings 27 moving outwardly under the action of centrifugal force. If the fuel pressure attains a sufficient value, then the rotor will move axially by a small amount to allow leakage of fuel from the aforesaid orifices and thereby the output pressure of the feed pump is controlled. With increasing speed the centrifugal force increases and therefore the fuel pressure must rise to a higher value in order for leakage to occur. As a result the output pressure of the feed pump varies in accordance with the law $(n^2+k)$ where n is the speed of rotation and k the constant of the spring 24.

It will be appreciated that the distance which the rotor moves will be very small and as a result the regulator will be little influenced by changes in the viscosity of the fuel. The regulator pressure can be easily adjusted by adjustment of the mass or number of balls or the inclination of the surface 25 or the strength of the spring.

I claim:

1. A pressure regulator for controlling the pressure at the outlet of a fluid pump in accordance with the speed at which the pump is driven comprising a rotary shaft arranged to be driven at the same speed as the pump, a first member in the form of a disc, a central aperture in said disc and through which said shaft extends, an orifice in said disc at a position spaced from the axis of rotation of the shaft, said orifice breaking out onto the opposite side faces of the disc, a second member in the form of a rotor carried on said shaft so as to rotate therewith but to be axially movable thereon, a side face defined on said rotor for engagement with one of the side faces of said disc to obturate said orifice, resilient means biasing said rotor into engagement with said disc, an annular surface defined on said rotor, said surface being inclined to a plane normal to the axis of rotation of the shaft, means defining a reaction surface presented to said annular surface, a plurality of balls disposed between said reaction surface and said annular surface and which when the rotor and shaft rotate move outwardly under the action of centrifugal force to impart an axial thrust to said rotor, the magnitude of said thrust depending upon the square of the speed at which the rotor is driven, a backing plate having a side face located against the other of said side surfaces of said disc and passage means in said backing plate through which said orifice is in communcation with said outlet, the fuel pressure at the outlet of the pump acting to separate said disc and said rotor in opposition to said axial thrust and to the force exerted by the resilient means, whereby the output pressure of the pump will be controlled in accordance with the law $N_2+K$ where N is the speed of rotation of the shaft and K the constant of the resilient means.

2. A pressure regulator according to claim 1 in which said resilient means comprises a coiled compression spring surrounding said shaft and acting between the rotor and the means defining said reaction surface.

3. A pressure regulator according to claim 1 including a plurality of orifices in said disc, said passage means including a circumferential groove in said face of the backing plate at a position to have constant communication with said orifices.

* * * * *